US009816330B2

(12) United States Patent
Delzell et al.

(10) Patent No.: US 9,816,330 B2
(45) Date of Patent: Nov. 14, 2017

(54) MULTIPLE CONTROL LINE TRAVEL JOINT WITH INJECTION LINE CAPABILITY

(71) Applicant: HALLIBURTON ENERGY SERVICES, INC., Houston, TX (US)

(72) Inventors: Christopher Robert Delzell, Plano, TX (US); William Mark Richards, Flower Mound, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 269 days.

(21) Appl. No.: 14/432,280

(22) PCT Filed: May 12, 2014

(86) PCT No.: PCT/US2014/037658
§ 371 (c)(1),
(2) Date: Mar. 30, 2015

(87) PCT Pub. No.: WO2015/174955
PCT Pub. Date: Nov. 19, 2015

(65) Prior Publication Data

US 2016/0258229 A1 Sep. 8, 2016

(51) Int. Cl.
*E21B 43/16* (2006.01)
*E21B 17/07* (2006.01)
*E21B 17/02* (2006.01)

(52) U.S. Cl.
CPC ..... *E21B 17/07* (2013.01); *E21B 17/025* (2013.01); *E21B 17/028* (2013.01)

(58) Field of Classification Search
CPC ..... E21B 17/07; E21B 17/025; E21B 17/028
(Continued)

(56) References Cited

U.S. PATENT DOCUMENTS

2004/0173352 A1 9/2004 Mullen et al.
2005/0072564 A1 4/2005 Grigsby et al.
(Continued)

FOREIGN PATENT DOCUMENTS

WO 2014130032 8/2014
WO 2014193419 12/2014
(Continued)

OTHER PUBLICATIONS

International Patent Application No. PCT/US2014/037658 , International Search Report and Written Opinion, dated Feb. 6, 2015, 12 pages.

*Primary Examiner* — Taras P Bemko
(74) *Attorney, Agent, or Firm* — Kilpatrick Townsend & Stockton LLP

(57) ABSTRACT

A multiple control line travel joint is disclosed having at least one non-coiled, fluid control line and at least one internal control line, such as a hydraulic, electrical, or fiber optic control line. The fluid control line can include an upper control line that enters the travel joint at a top port and a lower control line that exits out a bottom port of the travel joint. The top port and bottom port can be fluidly coupled through a sealed chamber in the travel joint. The second control line can be coiled within the sealed chamber. As the travel joint expands and contracts, the sealed chamber expands and contracts while remaining sealed, maintaining sealed fluid coupling between the top port and the bottom port.

18 Claims, 9 Drawing Sheets

(58) Field of Classification Search
USPC ..... 166/381
See application file for complete search history.

(56) References Cited

U.S. PATENT DOCUMENTS

| | | | | |
|---|---|---|---|---|
| 2010/0101778 | A1 | 4/2010 | Lembcke | |
| 2010/0206582 | A1* | 8/2010 | Meyyappan | E21B 17/1035 166/378 |
| 2011/0139458 | A1 | 6/2011 | Shafiq et al. | |
| 2011/0220348 | A1* | 9/2011 | Jin | E21B 17/042 166/244.1 |
| 2013/0025880 | A1 | 1/2013 | Richards et al. | |

FOREIGN PATENT DOCUMENTS

| | | |
|---|---|---|
| WO | 2014193420 | 12/2014 |
| WO | 2015005895 | 1/2015 |
| WO | 2015005897 | 1/2015 |

* cited by examiner

MULTIPLE CONTROL LINE TRAVEL JOINT WITH INJECTION LINE CAPABILITY

CROSS-REFERENCE TO RELATED APPLICATIONS

This is a U.S. national phase under 35 U.S.C. 371 of International Patent Application No. PCT/US2014/037658, titled "Multiple Control Line Travel Joint with Injection Line Capability" and filed May 12, 2014, the entirety of which is incorporated herein by reference.

TECHNICAL FIELD

The present disclosure relates to wellbore equipment generally and more specifically to control line travel joints.

BACKGROUND

Travel joints, including long space-out travel joints (LSOTJ), can be used in wellbore environments to allow for moving tools and other equipment further downwell of the travel joint without moving the entire workstring. The travel joint can extend and retract. Equipment further downwell of the travel joint can communicate through an electrical connection, an optical connection, or a fluid connection (e.g., for hydraulic controls) with the surface. Since travel joints can allow for thirty feet of stroke or more, electrical and optical conductors and fluid pathways that pass through the travel joint allow for expansion. Control lines, such as one-quarter-inch hydraulic lines, electrical lines, and fiber optic lines, can be coiled within a travel joint. Due to the limited space within a travel joint, the use of large hydraulic lines can be difficult. Additionally, larger hydraulic control lines, such as three-eighths-inch hydraulic lines, cannot be coiled as reliably as one-quarter-inch hydraulic lines and can break prematurely during coiling.

BRIEF DESCRIPTION OF THE DRAWINGS

The specification makes reference to the following appended figures, in which use of like reference numerals in different figures is intended to illustrate like or analogous components

DETAILED DESCRIPTION

Figure 1:
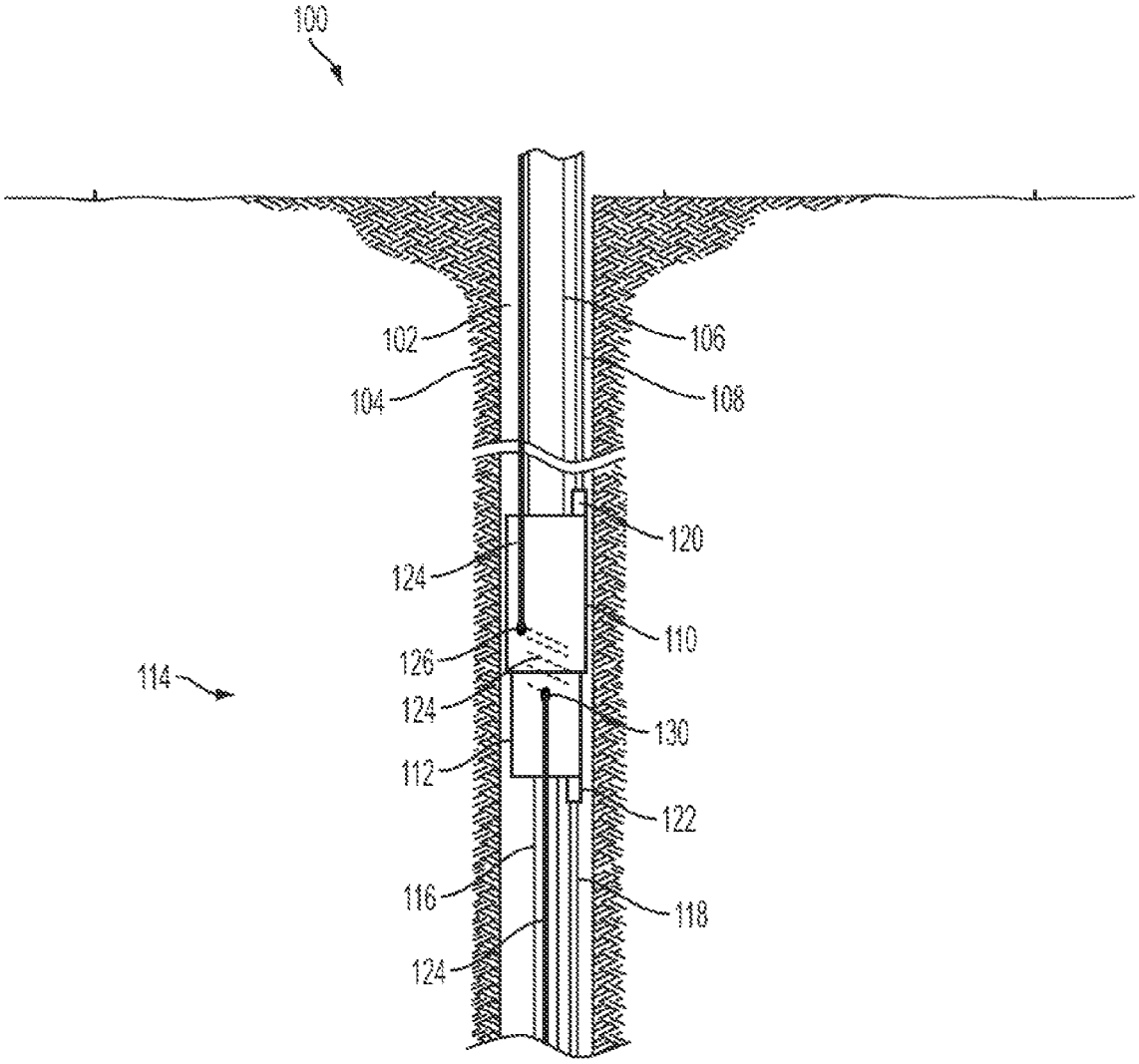
FIG. 1 is a schematic diagram of a wellbore-servicing system including a travel joint having multiple control lines in a retracted position according to one embodiment.

Certain aspects and features of the present disclosure relate to a multiple control line travel joint having at least one non-coiled, fluid control line and at least one internal control line, such as a hydraulic, electrical, or fiber optic control line. The fluid control line can be used to supply chemicals to the wellbore below the travel joint and can be sized to provide the volume of fluid needed. The fluid control line can include an upper control line that can enter the travel joint at a top port, and a lower control line that can exit out a bottom port of the travel joint. The top port and bottom port can be fluidly coupled through a sealed chamber in the travel joint. A second control line or multiple control lines can be used to provide power and communication to equipment attached to the tubing string below the travel joint. The control lines can be coiled to allow for the expansion and contraction of the travel joint. The second control line can be coiled within the sealed chamber. As the travel joint expands and contracts, the sealed chamber expands and contracts while remaining sealed, maintaining a sealed fluid coupling between the top port and the bottom port. A multiple control line travel joint can be a long space-out travel joint (LSOTJ). The travel joint can include multiple control lines. Examples of control lines can include hydraulic lines, electrical lines, and fiber optic lines. The travel joint can allow for thirty or more feet of stroke (e.g., between a retracted position and an extended position). Three-eighths-inch control line injection capabilities can be facilitated as described herein through the use of a sealed chamber within the travel joint. While the embodiments disclosed herein are described with reference to a three-eighths-inch control line, other fluid lines can be used with the sealed chamber instead of the three-eighths-inch control line. It can be desirable to use the sealed chamber with fluid lines having a diameter greater than one-quarter-inch.

An upper control line can be coupled to the top of the travel joint with a pressure fitting. A series of gun drill ports can fluidly couple the upper control line to the sealed chamber of the travel joint. A lower control line can be coupled to the bottom of the travel joint with a pressure fitting. Fluid can transfer from the upper control line to the lower control line through the sealed chamber. The sealed chamber can remain sealed at various positions, including a retracted position, an extended position, and a mid-stroke position.

One or more internal control lines, such as power and communication control lines, can be coiled within the sealed chamber to provide sufficient length for the travel joint to fully extend and compact without harming the internal control lines. As used herein, the term "internal control line" includes any control line that itself passes through the interior of the travel joint. Each internal control line enters the sealed chamber at respective upper feed-thru ports and exits the sealed chamber at respective lower feed-thru ports. Each feed-thru port can be a pressure fitting to ensure the sealed chamber remains sealed.

The travel joint can include a release feature positioned above or below the expansion coils of the internal control lines internal control line. The release feature can be a variety of mechanisms that are activated by tubing weight, tubing pressure, or other triggers. The release feature can be a timed hydraulic release, a j-track release, shear pins, a tubing pressure release, or an annulus pressure release. The release feature can be positioned within or outside of the sealed chamber. The release feature can be triggered by a pressure buildup in the sealed chamber.

In some embodiments, the travel joint can be a non-continuously sealing travel joint. The travel joint can include a fluid pathway between the inside of the travel joint and the outside of the travel joint. The fluid pathway can be sealed or closed when the travel joint is in an extended position and can be unsealed or open when the travel joint is in a retracted position. The fluid pathway can also be unsealed or open when the travel joint is in a mid-stroke position. When the fluid pathway is unsealed or open, fluid can equalize between the inside of the travel joint and the outside of the travel joint. The use of a non-continuously sealing travel joint can allow for pressure differentials between the inside of the travel joint and the outside of the travel joint to equalize, such as pressure differentials caused by temperature changes.

The present disclosure can allow for travel joints that include a three-eighths-inch control line as well as multiple internal control lines. The present disclosure can allow for the addition of a three-eighths-inch control line to a travel joint without the need to remove one or more control lines. The present disclosure can allow for the use of a three-eighths-inch control line without coiling the three-eighths-inch control line. Coiling of a three-eighths-inch control line can be difficult, space-consuming, and can lead to premature breakage of the control line.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a schematic diagram of a wellbore-servicing system 100 that includes a travel joint 114 having multiple control lines in a retracted position according to one embodiment. The wellbore-servicing system 100 also includes a wellbore 102 penetrating a subterranean formation 104 for the purpose of recovering hydrocarbons, storing hydrocarbons, disposing of carbon dioxide, or the like. The wellbore 102 can be drilled into the subterranean formation 104 using any suitable drilling technique. While shown as extending vertically from the surface in FIG. 1, in other examples the wellbore 102 can be deviated, horizontal, or curved over at least some portions of the wellbore 102. The wellbore 102 can be cased, open hole, contain tubing, and can include a hole in the ground having a variety of shapes or geometries.

A service rig, such as a drilling rig, a completion rig, a workover rig, or other mast structure or combination thereof can support a workstring 106 in the wellbore 102, but in other examples a different structure can support the workstring 106. For example, an injector head of a coiled tubing rigup can support the workstring 106. In some aspects, a service rig can include a derrick with a rig floor through which the workstring 106 extends downward from the service rig into the wellbore 102. The servicing rig can be supported by piers extending downwards to a seabed in some implementations. Alternatively, the service rig can be supported by columns sitting on hulls or pontoons (or both) that are ballasted below the water surface, which may be referred to as a semi-submersible platform or rig. In an off-shore location, a casing may extend from the service rig to exclude sea water and contain drilling fluid returns. Other mechanical mechanisms that are not shown may control the run-in and withdrawal of the workstring 106 in the wellbore 102. Examples of these other mechanical mechanisms include a draw works coupled to a hoisting apparatus, a slickline unit or a wireline unit including a winching apparatus, another servicing vehicle, and a coiled tubing unit.

The workstring 106 can include one or more travel joints 114. The travel joint 114 can include an upper tubular 110 and a lower tubular 112. As used herein, the terms "upper," "top," and the like refer to the direction towards the surface along the wellbore 102 while the terms "lower," "bottom," and the like refer to the direction away from the surface of the wellbore 102. A top port 120 located in the upper tubular 110 can accept an upper control line 108. The upper control line can be a three-eighths-inch control line, such as a pressurized fluid line. The upper control line can have a diameter larger than one-quarter-inch. A bottom port 122 located in the lower tubular 112 can accept a lower control line 118. The lower control line can be a three-eighths-inch control line, such as a pressurized fluid line. The lower control line can have a diameter larger than one-quarter-inch. The top port 120 and the bottom port 122 can be in fluid communication through a sealed chamber as described in greater detail below.

The upper tubular 110 can additionally include a top feed-thru port 126 that accepts an internal control line 124. The internal control line 124 can be any other control line capable of being coiled within the travel joint 114. Examples of internal control line 124 include a one-quarter-inch hydraulic line, an electrical line, and a fiber optic line. The internal control line 124 can pass through the top feed-thru port 126 and be coiled within the travel joint 114. The internal control line 124 can exit the lower tubular 112 out of a bottom feed-thru port 130. The internal control line 124 can be coiled within the sealed chamber of the travel joint 114, as described in further detail below, in order to allow the travel joint 114 to fully extend and retract without damaging the internal control line 124. Numerous internal control lines can be used in a single travel joint 114.

The lower tubular 112 can be coupled to a downwell tubular 116 to move the downwell tubular 116 axially. The lower tubular 112 can be coupled to a downwell tubular 116 to isolate axial movement of the downwell tubular 116 from the workstring 106, such as axial movement caused by temperature changes.

Figure 2:
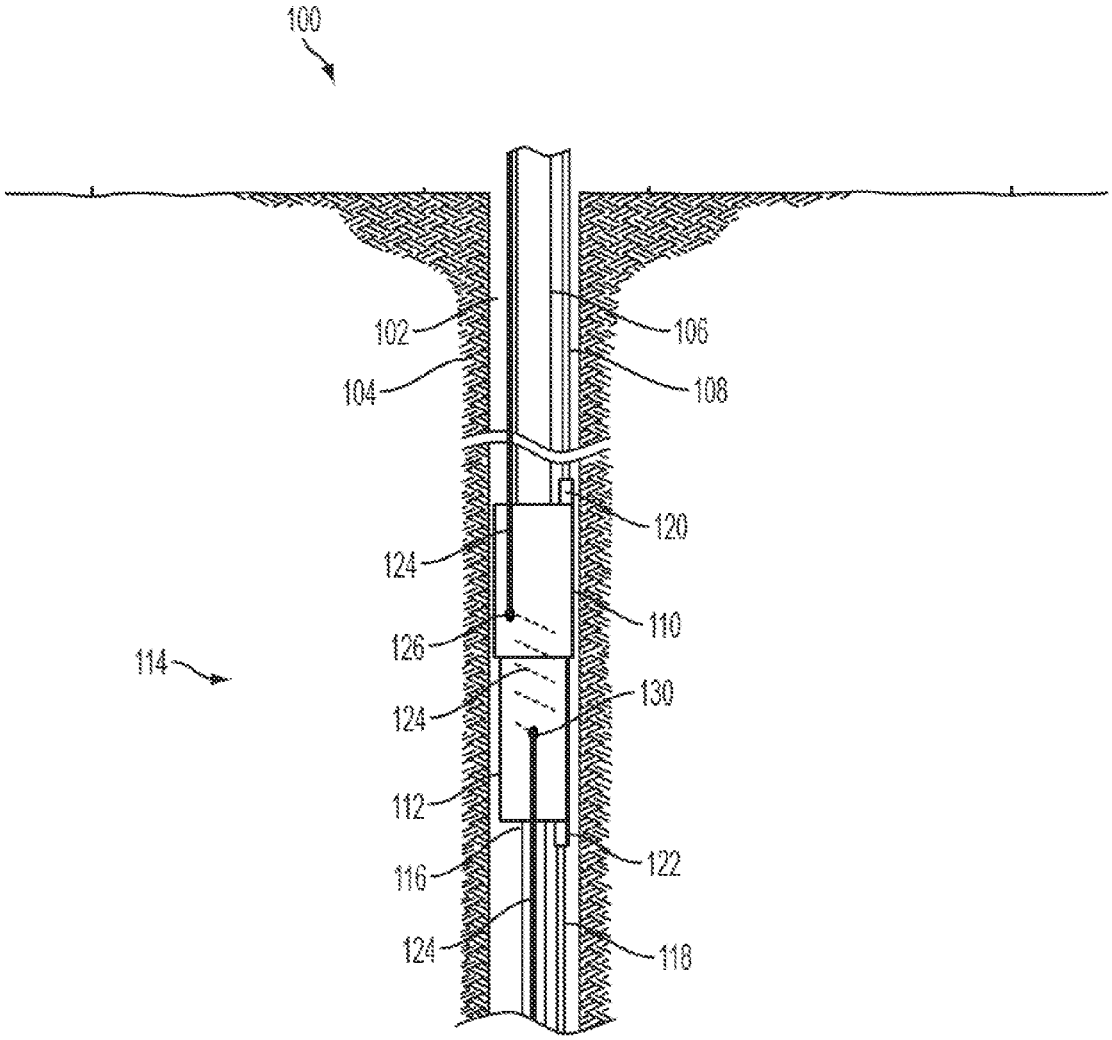
FIG. 2 is a schematic diagram of the wellbore-servicing system of FIG. 1 with the travel joint in an extended position according to one embodiment.

FIG. 2 is a schematic diagram of the wellbore-servicing system 100 of FIG. 1 with the travel joint 114 in an extended position according to one embodiment. The workstring 106 of the wellbore-servicing system 100 can be positioned in the wellbore 102 within the subterranean formation 104. The workstring 106 can include the travel joint 114 with the upper tubular 110 and the lower tubular 112. The upper control line 108 can be connected to the upper tubular 110 at top port 120. The lower control line 118 can be connected to the lower tubular 112 at bottom port 122. The internal control line 124 can enter the upper tubular 110 through top feed-thru port 126 and exit the lower tubular 112 through bottom feed-thru port 130. The downwell tubular 116 can be connected to the lower tubular 112.

In an extended position, the travel joint 114 can expand to occupy more linear distance, where the top port 120 is axially displaced farther from the bottom port 122 and the top feed-thru port 126 is axially displaced farther from the bottom feed-thru port 130. Additionally, the downwell tubular 116 is axially displaced further from the upper tubular 110. The lower control line 118, internal control line 124, and downwell tubular 116 are able to reach further into the wellbore 102 when the travel joint 114 is in an extended position.

Figure 3A:
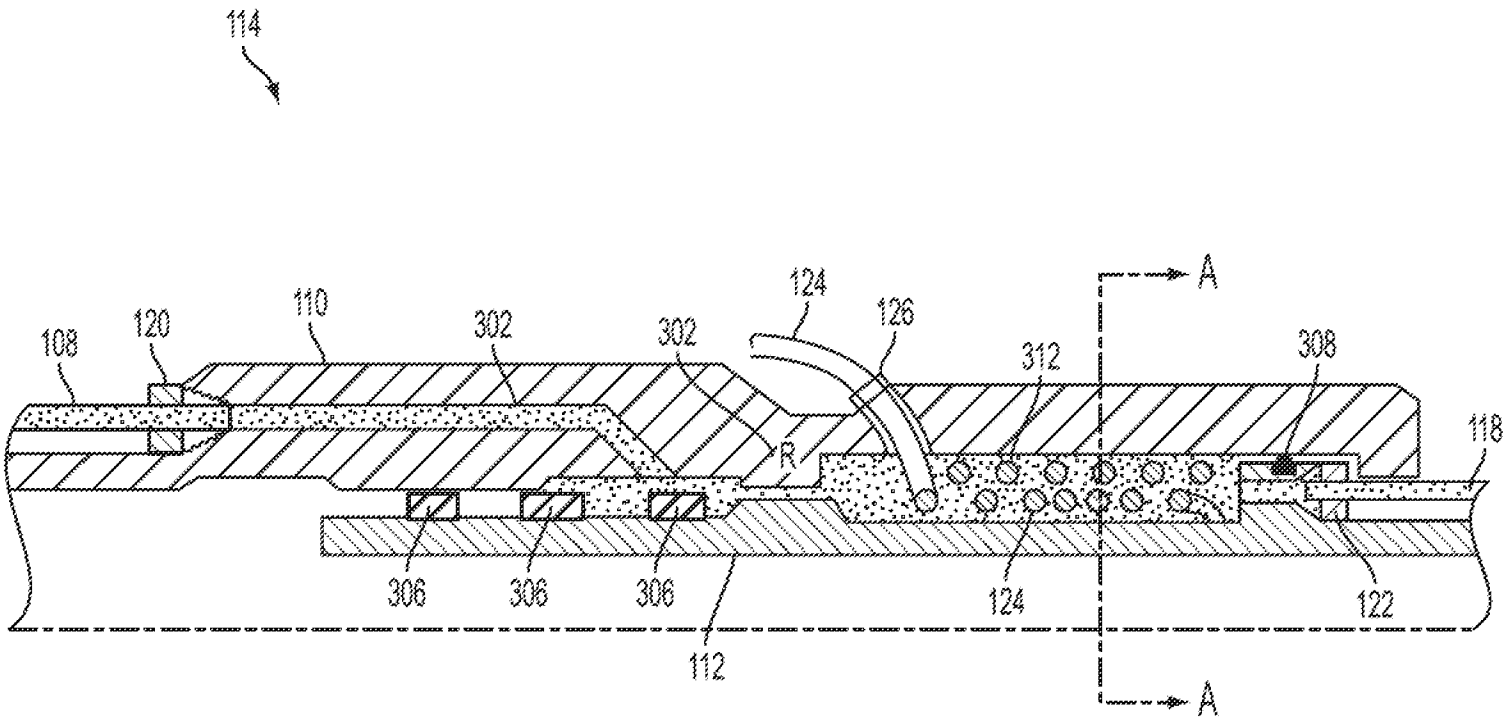
FIG. 3A is a cross-sectional view of a travel joint that can continuously seal in an extended position according to one embodiment.

FIG. 3A is a cross-sectional view of a travel joint 114 that is continuously sealing according to one embodiment. The upper control line 108 can enter the upper tubular 110 through a top port 120. Fluid from the upper control line 108 can pass through the top port 120 into the sealed chamber 302. Fluid can exit the sealed chamber 302 at bottom port 122 and out through the lower control line 118. The top port 120 and bottom port 122 can both include pressure fittings.

An internal control line 124 can enter the sealed chamber 302 through the top feed-thru port 126 in the upper tubular 110. The internal control line 124 can form coils within the sealed chamber 302 and exit the sealed chamber 302 at a bottom feed-thru port 130. The bottom feed-thru port 130 can be angularly offset from the bottom port 122. A second internal control line 312 can be coiled within the sealed chamber 302. The second internal control line 312 can enter and exit the sealed chamber 302 at respective top and bottom feed-thru ports.

The internal control lines 124, 312 can be coated to be protected from the fluid passing through the sealed chamber 302. The internal control lines 124, 312 can be encapsulated with plastics such as Stantaprene or Polypropolene or other similar plastics commonly used for encapsulation of control lines.

The metallurgy of the upper tubular 110 and lower tubular 112 can be selected to be compatible with the fluid used in the sealed chamber 302. In some embodiments, selected coatings that are compatible with the fluid used in the sealed chamber 302 can be applied to the surfaces of the upper tubular 110 and the lower tubular 112 defining the sealed chamber 302.

One or more upper seals 306 can seal the sealed chamber 302 between the upper tubular 110 and the lower tubular 112 near the upper end of the lower tubular 112. Because of the potential for large pressure differentials between the inside of the travel joint 114 and the sealed chamber 302, the upper seals 306 can be premium seal stacks, such as chevron type seals. The upper seals 306 can be seals made from a combination of materials, including Polyether ether ketone (PEEK), Ryton, Nylon, or Dycon. The upper seals 306 can be designed to withstand pressures up to 15,000 PSI and temperatures up to 400° F.

One or more lower seals 308 can seal the sealed chamber 302 between the upper tubular 110 and the lower tubular 112 near the lower end of the upper tubular 110. Because of the likelihood of low pressure differentials between the outside of the travel joint 114 and the sealed chamber 302, the lower seals 308 can be non-premium seal stack or a lower pressure seal than the upper seals 306. In alternate embodiments, the lower seals 308 can be premium seal stacks.

A release feature 310 can be located within the travel joint 114. The release feature 310 can be located on the upper tubular 110, the lower tubular 112, or between the upper tubular 110 and the lower tubular 112. The release feature can be any features suitable to keep the travel joint 114 locked in a certain position until triggered. The release feature can keep the lower tubular 112 axially fixed with respect to the upper tubular 110 until triggered. The release feature can keep the travel joint 114 locked in a retracted position, an extended position, or a mid-stroke position until triggered. Upon being triggered, the release feature can release, or unlock, the travel joint 114, allowing it to expand or contract as desired.

The release feature 310 can be a shear device that allows the travel joint 114 to be inserted into a wellbore 102 in a locked state, but upon application of sufficient force from the workstring 106, will cause the shear device to break, unlocking the travel joint 114.

The release feature 310 can be a j-track device that can include a pin within a curved groove. The travel joint 114 can be inserted into a wellbore 102 in a locked state and as the weight of the travel joint 114 is set down, the pin can move to a second position within the groove, allowing it to then move to a third position in the groove when the travel joint 114 is lifted, further allowing the pin to move to a fourth position in the groove when the travel joint 114 is pushed down again, at which point the travel joint 114 can be in an unlocked state.

The release feature 310 can be a hydraulically activated dog that can be controlled to unlock the travel joint 114. In some embodiments, the hydraulically activated dog can additionally relock the travel joint 114. The hydraulically activated dog can be controlled from the surface.

The release feature 310 can be a pressure-activated release that responds to a buildup of pressure within the sealed chamber 302. After the travel joint 114 is inserted into the wellbore 102, pressurized fluid can be forced into the sealed chamber 302 by upper control line 108. Once the pressure within the sealed chamber 302 reaches a predetermined level, the pressure-activated release can unlock the travel joint 114. The bottom port 122 can be temporarily occluded in order to allow pressure to build up in the sealed chamber 302 without fluid passing through the lower control line 118. The bottom port 122 can be temporarily occluded when the travel joint 114 is in a locked state.

Stroking of the travel joint 114 can be accomplished by applying compression through the workstring 106.

Figure 3B:
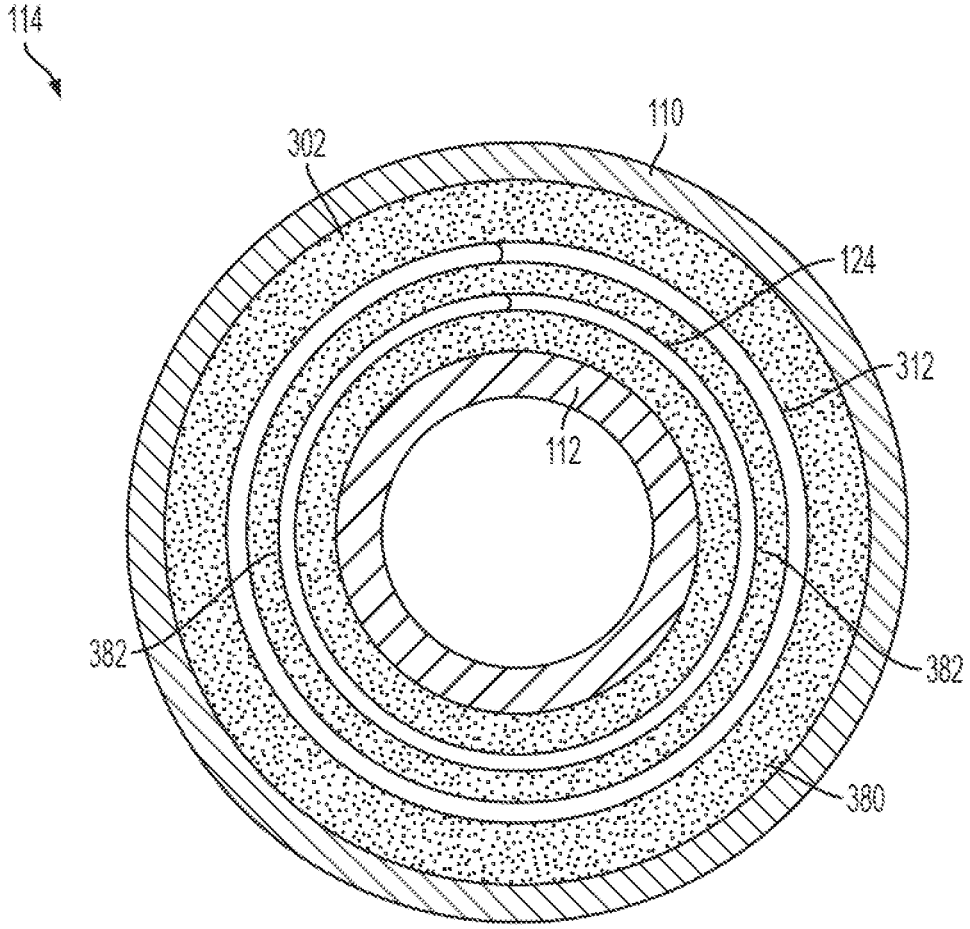
FIG. 3B is a cross-sectional view of the travel joint of FIG. 3A taken across line A-A according to one embodiment.

FIG. 3B is a cross-sectional view of the travel joint 114 of FIG. 3A taken across line A:A according to one embodiment. The travel joint 114 can include a sealed chamber 302. The internal control line 124 and second internal control line 312 can be coiled within the sealed chamber 302.

Figure 4:
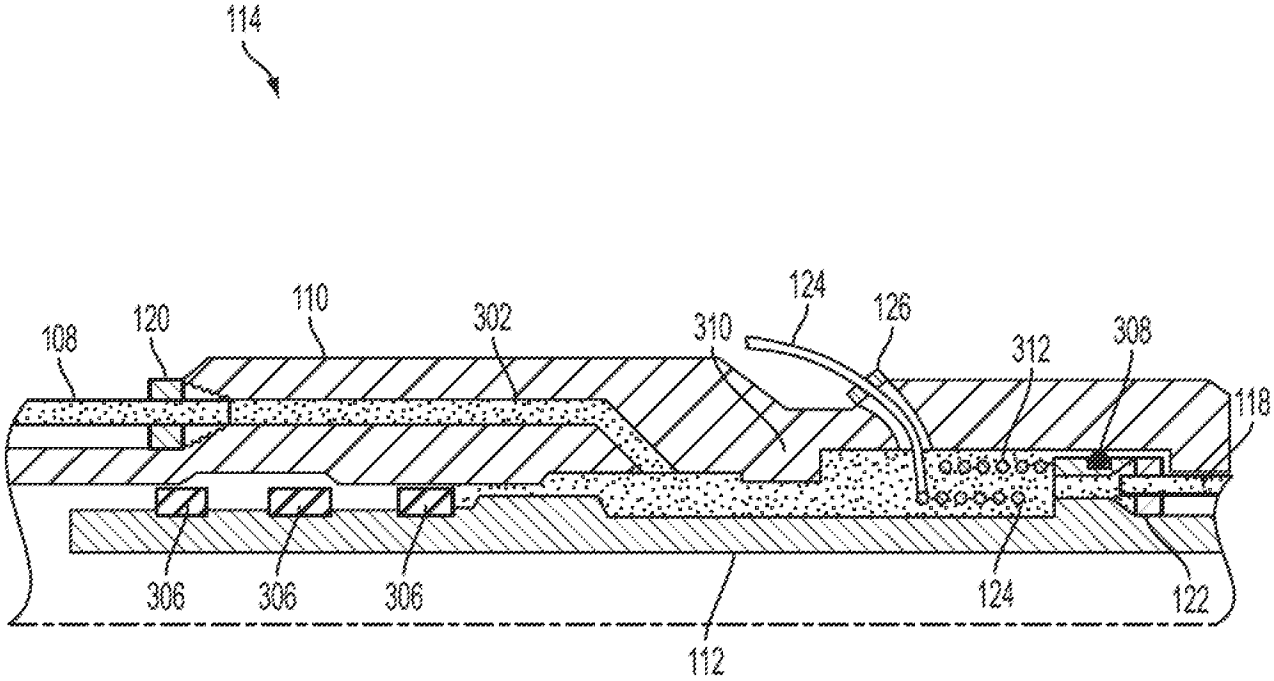
FIG. 4 is a cross-sectional view of the travel joint of FIG. 3A in a retracted position according to one embodiment.

FIG. 4 is a cross-sectional view of the travel joint 114 of FIG. 3A in a retracted position according to one embodiment. In the retracted position, the lower tubular 112 is positioned further within the upper tubular 110. The internal control line 124 that enters through the top feed-thru port 126 can be coiled within the sealed chamber 302 with a tight, compressed coil. The second internal control line 312 can also be in a tight, compressed coil. The upper seals 306 can be positioned further upwards along the upper tubular 110, as well as the lower seals 308. The top port 120 that accepts the upper control line 108 can be positioned closer to the bottom port 122 that accepts the lower control line 118. The release feature 310 can be in a released, or unlocked, state.

Figure 5:
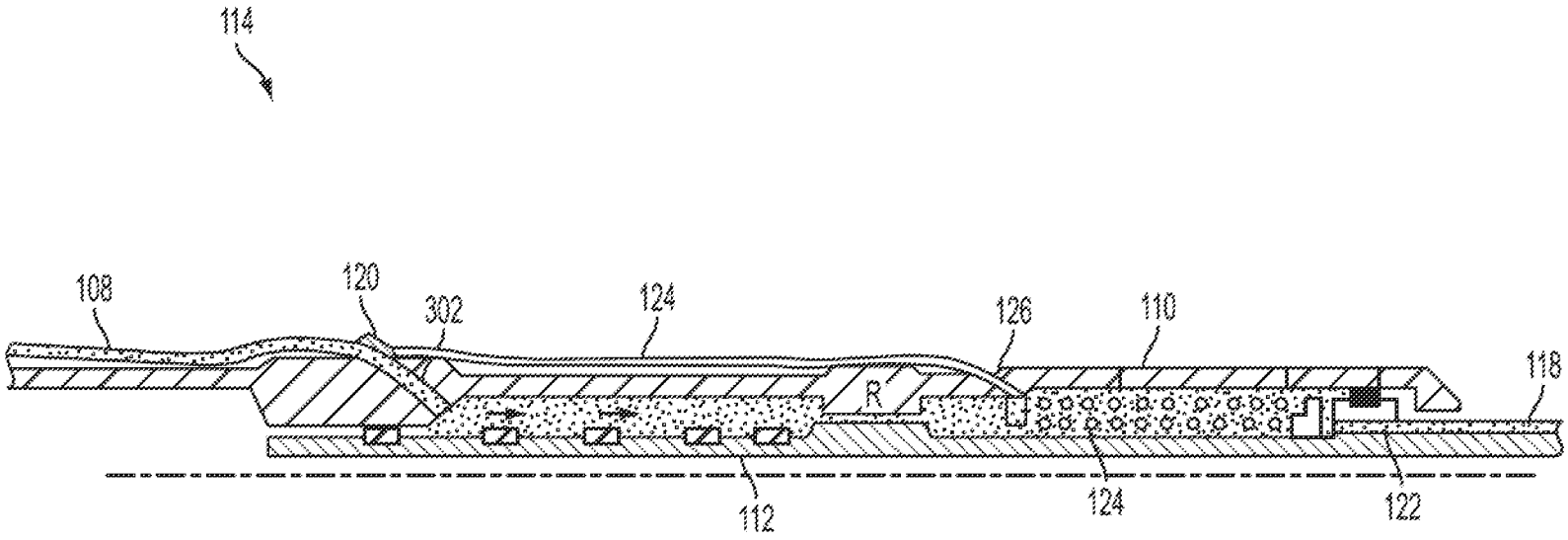
FIG. 5 is a cross-sectional view of a travel joint in an extended position according to one embodiment.

FIG. 5 is a cross-sectional view of a travel joint 114 in an extended position according to one embodiment. The travel joint 114 can have a low profile. The top port 120 that accepts the upper control line 108 can be at a farthest available distance from the bottom port 122 that accepts the lower control line 118. The lower tubular 112 can be positioned as far out of the bottom of the upper tubular 110 as possible in the extended position. The internal control line 124 that enters the sealed chamber through top feed-thru port 126 can be coiled in a less compressed coil within the sealed chamber 302.

Figure 6:
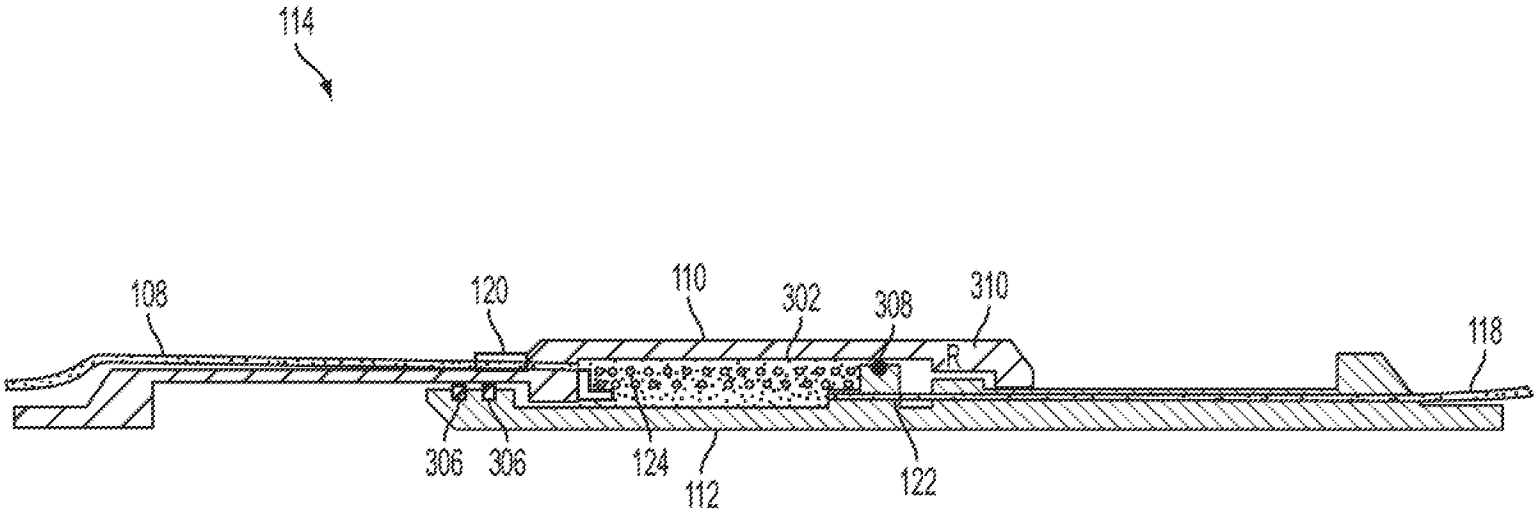
FIG. 6 is a cross-sectional view of a travel joint that can continuously seal in an extended position with a release feature external to a sealed chamber according to one embodiment.

FIG. 6 is a cross-sectional view of a travel joint 114 that is continuously sealing in an extended position with a release feature 310 outside of the sealed chamber 302 according to one embodiment. The top port 120 can accept upper control line 108. The bottom port 122 can accept lower control line 118. The internal control line 128 can be coiled within the sealed chamber 302. The upper seals 306 and lower seals 308 can create fluid barriers between the lower tubular 112 and the upper tubular 110 in various positions, such as a retracted position and an extended position. There is no fluid pathway between the inside of the travel joint 114 to the outside of the travel joint 114.

Figure 7:
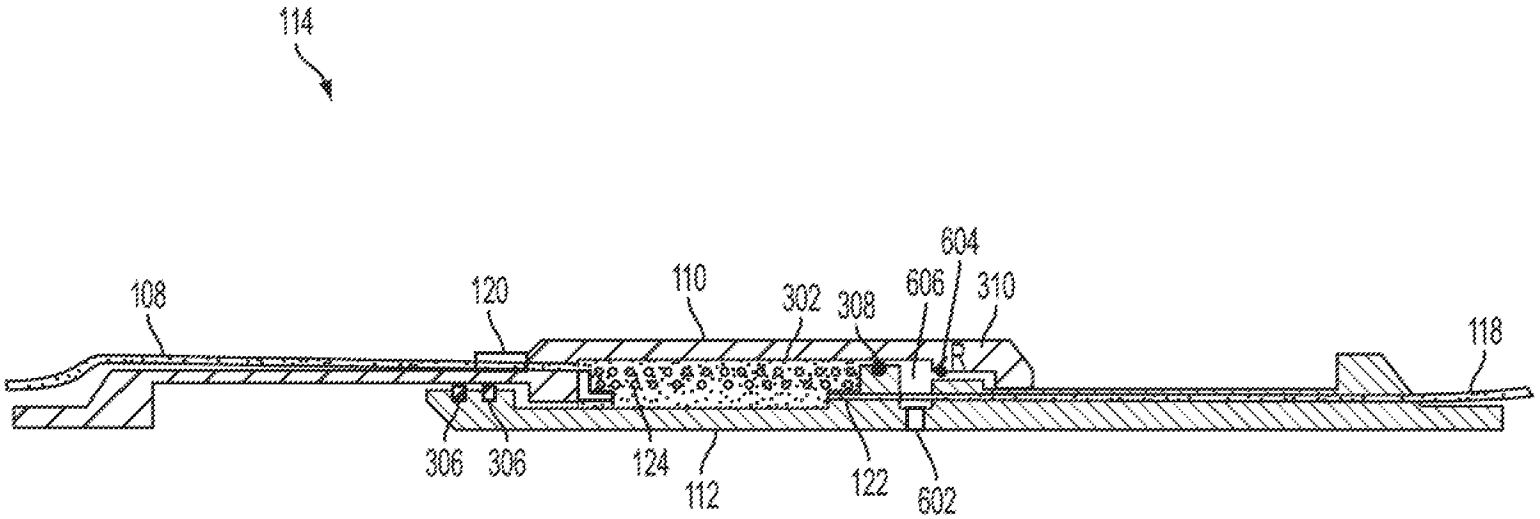
FIG. 7 is a cross-sectional view of a travel joint that is non-continuously sealing in an extended position according to one embodiment.

FIG. 7 is a cross-sectional view of a travel joint 114 that is non-continuously sealing in an extended position according to one embodiment. The top port 120 in the upper tubular 110 can accept upper control line 108. The bottom port 122 in the lower tubular 112 can accept lower control line 118. The internal control line 128 can be coiled within the sealed chamber 302 that is sealed between upper seals 306 and lower seals 308. The lower tubular 112 can include a port 602 between the inside of the travel joint 114 and an inner annulus 606 of the travel joint 114. The inner annulus 606 of the travel joint 114 can be sealed on one end by the lower seals 308 and on the other end by annulus seals 604.

In some embodiments, annulus seals 604 are not premium seal stacks because generally a very large pressure differential (e.g., a pressure differential necessitating a premium seal stack) will not be present across the annulus seals 604 because such large pressure differentials are usually present only when the travel joint 114 is in a mid-stroke or retracted position. In alternate embodiments, annulus seals 604 can be premium seal stacks, as described above with reference to upper seals 306.

When the travel joint 114 is in an extended position, the inner annulus 606 can be sealed to the outside of the travel joint 114 by the annulus seals 604 forming a seal between the upper tubular 110 and the lower tubular 112. When the travel joint 114 is in a mid-stroke or retracted position, the inner annulus 606 can fluidly couple the inside of the travel joint 114 with the outside of the travel joint 114.

Figure 8:
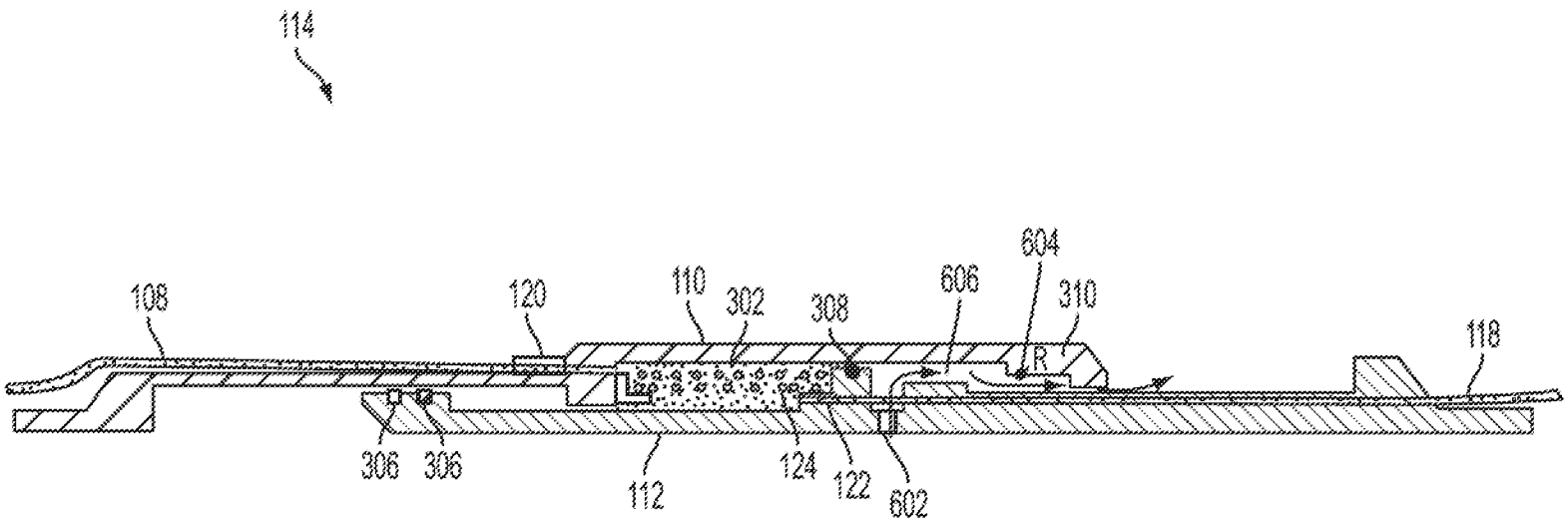
FIG. 8 is a cross-sectional view of a travel joint that is non-continuously sealing in a mid-stroke position according to one embodiment.

FIG. 8 is a cross-sectional view of a travel joint 114 that is non-continuously sealing in a mid-stroke position according to one embodiment. The top port 120 in the upper tubular 110 can accept upper control line 108. The bottom port 122 in the lower tubular 112 can accept lower control line 118. The internal control line 128 can be coiled within the sealed chamber 302 that is sealed between upper seals 306 and lower seals 308.

When the travel joint 114 is in a mid-stroke position, or not in an extended position, the annulus seals 604 are no longer creating a seal between the upper tubular 110 and the lower tubular 112. The inner annulus 606 now fluidly couples the inside of the travel joint 114 to the outside of the travel joint 114 through port 602.

In some instances, such as when changing from a production well to an injection well, large amounts of sea water can be injected into the well through the upper control line 108 and sealed chamber 302. Due to the cooler temperature of the sea water, tubing can contract causing the travel joint 114 to extend. In other instances, other temperature changes in the downhole well environment can cause the travel joint 114 to extend or contract. Fluid communication between the inside of the travel joint 114 and the outside of the travel joint 114 via the inner annulus 606 can equalize pressure differentials that may be created by extension or contraction of the travel joint 114.

Packers can be set below and above the travel joint 114. If fluid outside of the travel joint 114 begins to warm and expand, it can cause ruptures, such as ruptures in the packers or the travel joint 114. Fluid communication between the inside of the travel joint 114 and the outside of the travel joint 114 via the inner annulus 606 can equalize pressure differentials between the inside of the travel joint 114 and the outside of the travel joint 114 and reduce the risk of rupture due to temperature and pressure changes in the environment outside of the travel joint 114.

In some embodiments, the travel joint 114 includes more than one port 602.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a system including a sealed chamber defined between an outer tubular and an inner tubular. The inner tubular is axially slidable with respect to the outer tubular between a refracted position and an extended position. The system also includes an upper port in the outer tubular designed to fluidly couple an upper control line with the sealed chamber and a lower port in the inner tubular designed to fluidly couple a lower control line with the sealed chamber. The system also includes an upper feed-thru port and a lower feed-thru port adapted to accept an internal control line for being coiled within the sealed chamber.

Example 2 is the system of Example 1 with the upper port designed to receive an upper control line that is larger than one-quarter inch in diameter and the lower port designed to receive a lower control line that is larger than one-quarter inch in diameter.

Example 3 is the system of Examples 1 or 2 additionally comprising a release feature positioned adjacent the sealed chamber and operable to retain the inner tubular axially fixed with respect to the outer tubular until triggered.

Example 4 is the system of Example 3 where the release feature is selected from the group consisting of a timed hydraulic release, a j-track release, shear pins, a tubing pressure release, and an annulus pressure release.

Example 5 is the system of Examples 3 or 4, where the release feature is designed to be triggered by an increase in pressure within the sealed chamber beyond a predetermined amount.

Example 6 is the system of Examples 1-5 additionally including a second upper feed-thru port and a second lower feed-thru port adapted to accept a second internal control line for being coiled within the sealed chamber.

Example 7 is the system of Examples 1-6 where the internal control line includes a coating or plastic encapsulation adapted to protect the internal control line from a fluid pumped through the sealed chamber.

Example 8 is the system of Examples 1-7 where the sealed chamber is a continuously-sealed chamber.

Example 9 is the system of Examples 1-8 additionally including a fluid pathway between an inside of the inner tubular and an outside of the outer tubular operable to be open when the inner tubular is not in the extended position and closed when the inner tubular is in the extended position.

Example 10 is a method that includes shifting a travel joint having a control line between a retracted position and an extended position and pumping a fluid into an upper port of the travel joint, through a sealed chamber in the travel joint, and out of a lower port of the travel joint.

Example 11 is the method of Example 10 further including triggering a release mechanism to enable the travel joint to move between the refracted position and the extended position, wherein the release mechanism is selected from the group consisting of a timed hydraulic release, a j-track release, shear pins, a tubing pressure release, and an annulus pressure release.

Example 12 is the method of Example 11 where the triggering the release mechanism occurs in response to pressurizing the fluid in the sealed chamber.

Example 13 is the method of Examples 10-12 further including opening a port between an inside of the travel joint and an outside of the travel joint in response to shifting the travel joint to the retracted position.

Example 14 is a system that includes a travel joint movable between an extended position and a retracted position and having a sealed chamber in fluid communication with an upper control line and a lower control line, the sealed chamber designed to accept a second control line coiled within the sealed chamber.

Example 15 is the system of Example 14 where the upper control line and the lower control line are three-eighths-inch control lines.

Example 16 is the system of Examples 14 or 15 where the travel joint additionally includes a release feature positioned adjacent the sealed chamber and operable to retain the travel joint in the retracted position until triggered.

Example 17 is the system of Example 16 where the release feature is triggered by an increase in pressure within the sealed chamber beyond a predetermined amount.

Example 18 is the system of Examples 14-17 where the sealed chamber is designed to accept a third control line coiled within the sealed chamber.

Example 19 is the system of Examples 14-18 where the second control line includes a coating adapted to protect the second control line from a fluid pumped through the sealed chamber.

Example 20 is the system of Examples 14-19 where the travel joint additionally includes a fluid pathway between an inside of the travel joint and an outside of the travel joint operable to be open when the travel joint is in the retracted position and closed when the travel joint is in the extended position.

What is claimed is:

1. A system, comprising:

a sealed chamber defined between an outer tubular and an inner tubular axially slidable with respect to the outer tubular between a retracted position and an extended position;

an upper port in the outer tubular designed to fluidly couple an upper control line with the sealed chamber;

a lower port in the inner tubular designed to fluidly couple a lower control line with the sealed chamber; and an upper feed-thru port and a lower feed-thru port adapted to accept an internal control line for being coiled within the sealed chamber.

2. The system of claim 1 wherein the upper port is designed to receive an upper control line that is larger than one-quarter inch in diameter and the lower port is designed to receive a lower control line that is larger than one-quarter inch in diameter.

3. The system of claim 1 additionally comprising a release feature positioned adjacent the sealed chamber and operable to retain the inner tubular axially fixed with respect to the outer tubular until triggered.

4. The system of claim 3 wherein the release feature is selected from the group consisting of a timed hydraulic release, a j-track release, shear pins, a tubing pressure release, and an annulus pressure release.

5. The system of claim 3, wherein the release feature is designed to be triggered by an increase in pressure within the sealed chamber beyond a predetermined amount.

6. The system of claim 1 additionally comprising a second upper feed-thru port and a second lower feed-thru port adapted to accept a second internal control line for being coiled within the sealed chamber.

7. The system of claim 1 wherein the internal control line includes a coating or plastic encapsulation adapted to protect the internal control line from a fluid pumped through the sealed chamber.

8. The system of claim 1, wherein the sealed chamber is a continuously-sealed chamber.

9. The system of claim 1 additionally comprising a fluid pathway between an inside of the inner tubular and an outside of the outer tubular operable to be open when the inner tubular is not in the extended position and closed when the inner tubular is in the extended position.

10. A method, comprising:

shifting a travel joint having a control line between a retracted position and an extended position;

pumping a fluid into an upper port of the travel joint, through a sealed chamber in the travel joint, and out of a lower port of the travel joint; and opening a port between an inside of the travel joint and an outside of the travel joint in response to shifting the travel joint to the retracted position.

11. The method of claim 10 further comprising triggering a release mechanism to enable the travel joint to move between the retracted position and the extended position, wherein the release mechanism is selected from the group consisting of a timed hydraulic release, a j-track release, shear pins, a tubing pressure release, and an annulus pressure release.

12. The method of claim 11, wherein triggering the release mechanism occurs in response to pressurizing the fluid in the sealed chamber.

13. A system, comprising:

a travel joint movable between an extended position and a retracted position and having a sealed chamber in fluid communication with an upper control line and a lower control line, the sealed chamber designed to accept a second control line coiled within the sealed chamber, the travel joint additionally including a fluid pathway between an inside of the travel joint and an outside of the travel joint, the fluid pathway being operable to be open when the travel joint is in the retracted position and closed when the travel joint is in the extended position.

14. The system of claim 13 wherein the upper control line and the lower control line are three-eighths-inch control lines.

15. The system of claim 13 wherein the travel joint additionally includes a release feature positioned adjacent the sealed chamber and operable to retain the travel joint in the retracted position until triggered.

16. The system of claim 15, wherein the release feature is triggered by an increase in pressure within the sealed chamber beyond a predetermined amount.

17. The system of claim 13 wherein the sealed chamber is designed to accept a third control line coiled within the sealed chamber.

18. The system of claim 13, wherein the second control line includes a coating adapted to protect the second control line from a fluid pumped through the sealed chamber.

* * * * *